US011585492B1

(12) United States Patent
Pang et al.

(10) Patent No.: US 11,585,492 B1
(45) Date of Patent: Feb. 21, 2023

(54) LIGHT EMITTING ASSEMBLY AND LIGHT EMITTING DEVICE WITH MULTIPLE PATTERNS

(71) Applicant: GUANGZHOU COLORFUL STAGE EQUIPMENT CO., LTD, Guangzhou (CN)

(72) Inventors: Haiquan Pang, Guangzhou (CN); Biao Xia, Guangzhou (CN); Minghua Yang, Guangzhou (CN)

(73) Assignee: GUANGZHOU COLORFUL STAGE EQUIPMENT CO., LTD, Guangzhou (CN)

( * ) Notice: Subject to any disclaimer, the term of this patent is extended or adjusted under 35 U.S.C. 154(b) by 0 days.

(21) Appl. No.: 17/743,426

(22) Filed: May 12, 2022

(30) Foreign Application Priority Data

Apr. 28, 2022 (CN) ..... 202221038041.6

(51) Int. Cl.

| | |
|---|---|
| ***F21K 9/20*** | (2016.01) |
| ***F21V 5/00*** | (2018.01) |
| ***F21V 5/04*** | (2006.01) |
| ***H05B 45/30*** | (2020.01) |
| ***F21V 14/06*** | (2006.01) |
| *F21S 10/00* | (2006.01) |
| *F21W 121/00* | (2006.01) |

(52) U.S. Cl.
CPC ..... *F21K 9/20* (2016.08); *F21V 5/007* (2013.01); *F21V 5/04* (2013.01); *F21V 14/06* (2013.01); *H05B 45/30* (2020.01); *F21S 10/00* (2013.01); *F21W 2121/00* (2013.01)

(58) Field of Classification Search
CPC ... F21K 9/20; F21V 5/007; F21V 5/04; H05B 45/30; F21W 2121/008; F21S 8/035; F21S 10/007
See application file for complete search history.

(56) References Cited

U.S. PATENT DOCUMENTS

| | | | | |
|---|---|---|---|---|
| 6,558,022 | B2 * | 5/2003 | Kawahara | F21V 5/04 446/485 |
| 7,938,558 | B2 * | 5/2011 | Wilcox | F21V 25/12 362/267 |
| 10,234,118 | B2 * | 3/2019 | Zhang | F21V 14/06 |
| 11,118,753 | B1 * | 9/2021 | Zheng | F21S 10/00 |
| 11,281,083 | B1 * | 3/2022 | Xin | G03B 21/145 |
| 11,287,094 | B2 * | 3/2022 | Zheng | F21V 33/0056 |
| 11,408,573 | B1 * | 8/2022 | Johnson | G02B 5/18 |
| 11,454,375 | B1 * | 9/2022 | Xiong | G02B 27/425 |
| 2021/0247039 | A1 * | 8/2021 | Zheng | F21V 5/04 |

* cited by examiner

*Primary Examiner* — Oluseye Iwarere
*Assistant Examiner* — Michael Chiang

(57) ABSTRACT

Disclosed are a light emitting assembly and a light emitting device. The light emitting device includes a first light emitting element, a first light transmission portion and a driving portion, The first light emitting element emits a first light beam. The driving portion can drive the first light emitting element or the first light transmission portion, such that a position relationship between the first light emitting element and the first light transmission portion is switchable between a first state and a second state. In the first state, the first light beam passing through the first light transmission portion presents a first pattern; in the second state, the first light beam passing through the first light transmission portion presents a second pattern which is different from the first pattern.

20 Claims, 13 Drawing Sheets

LIGHT EMITTING ASSEMBLY AND LIGHT EMITTING DEVICE WITH MULTIPLE PATTERNS

CROSS REFERENCE OF RELATED APPLICATIONS

The present application claims priority of Chinese Utility Model Application No. 202221038041.6, filed on Apr. 28, 2022, the entire contents of which are hereby incorporated by reference.

TECHNICAL HELD

The present disclosure relates to the technical field of light emitting devices, and particularly to a light emitting assembly and a light emitting device.

BACKGROUND

A light emitting assembly is commonly used in a light emitting device, such as an illuminating apparatus or a projecting device. The light emitting assembly has a light emitting element, and light emitted from the light emitting element is used to illuminate or display a pattern. However, the luminous effect achieved by traditional light emitting assembly is too simple.

SUMMARY

The present disclosure provides a light emitting assembly and a light emitting device, which can enrich the luminous effect of the light emitting assembly.

A light emitting assembly, which includes a first light emitting element, a first light transmission portion and a driving portion. The first light emitting element is configured to generate a first light beam. The first light transmission portion is at least partially disposed within a propagation path of the first light beam. The driving portion is configured to drive one of the first light emitting element and the first light transmission portion, such that a position relationship between the first light emitting element and the first light transmission portion is switchable between a first state and a second state. When the first light transmission portion and the first light emitting element are in the first state, the first light beam passing through the first light transmission portion presents a first pattern; and when the first light transmission portion and the first light emitting element are in the second state, the first light beam passing through the first light transmission portion presents a second pattern which is different from the first pattern.

The present disclosure further provides a light emitting device, including a housing and the light emitting assembly mentioned above. The housing defines an accommodating cavity and the light emitting assembly is received in the accommodating cavity of the housing.

In the light emitting assembly provided by the present disclosure, a first light beam generated by a first light emitting element irradiates an external object after passing through a first light transmission portion, and projects a preset pattern on the external object. In particular, the light emitting assembly further includes a driving portion which can drive the first light emitting element or the first light transmission portion. The first light emitting element and the first light transmission portion can be in a first relative position or a second relative position. The driving portion can drive the first light emitting element or the first light transmission portion, such that a position relationship between the first light emitting element and the first light transmission portion is switchable between a first state and a second state. When the first light transmission portion and the first light emitting element are in the first state, the first light beam passing through the first light transmission portion presents a first pattern; and when the first light transmission portion and the first light emitting element are in the second state, the first light beam passing through the first light transmission portion presents a second pattern which is different from the first pattern. This enables the light emitting element to project at least two different patterns to the outside, thereby enriching the luminous effect of the light emitting assembly, and enabling the light emitting assembly to adapt to different usage scenarios or atmospheres.

BRIEF DESCRIPTION OF THE DRAWINGS

In order to illustrate technical solutions of embodiments of the present disclosure more clearly, accompanying drawings required to be used in the embodiments of the present disclosure will be briefly introduced below. Obviously, the accompanying drawings described below are only some embodiments of the present disclosure.

DESCRIPTION OF THE EMBODIMENTS

Figure 1:
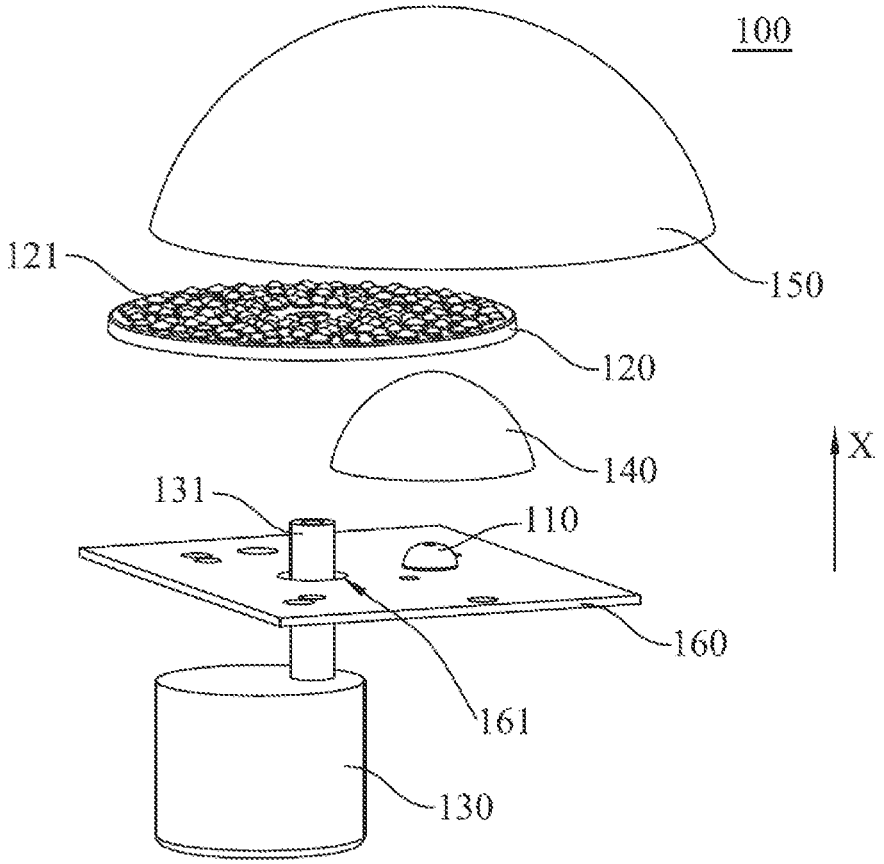
FIG. 1 is an exploded schematic view of a light emitting assembly according to a first embodiment of the present disclosure.
Figure 2:
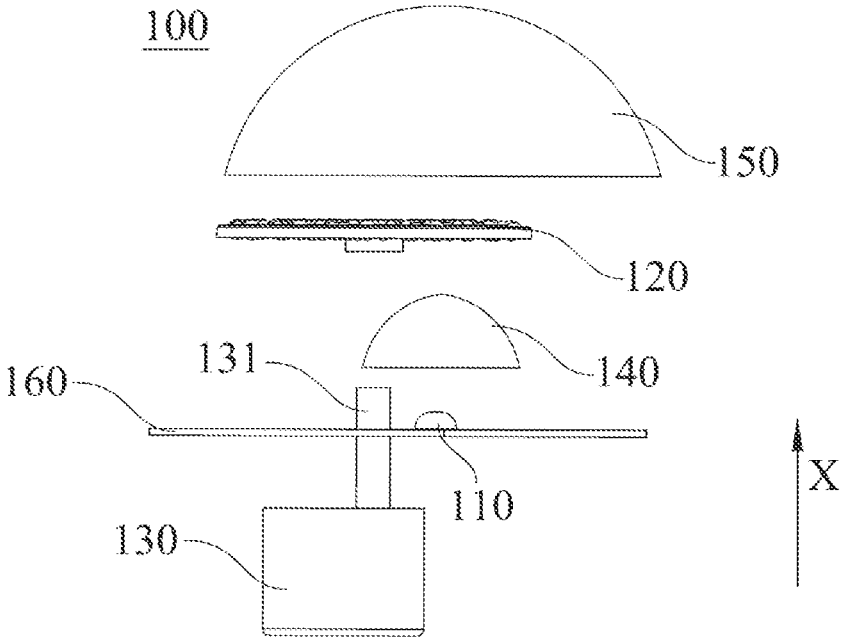
FIG. 2 is an exploded schematic view of a side view of the light emitting assembly according to the first embodiment of the present disclosure.
Figure 3:
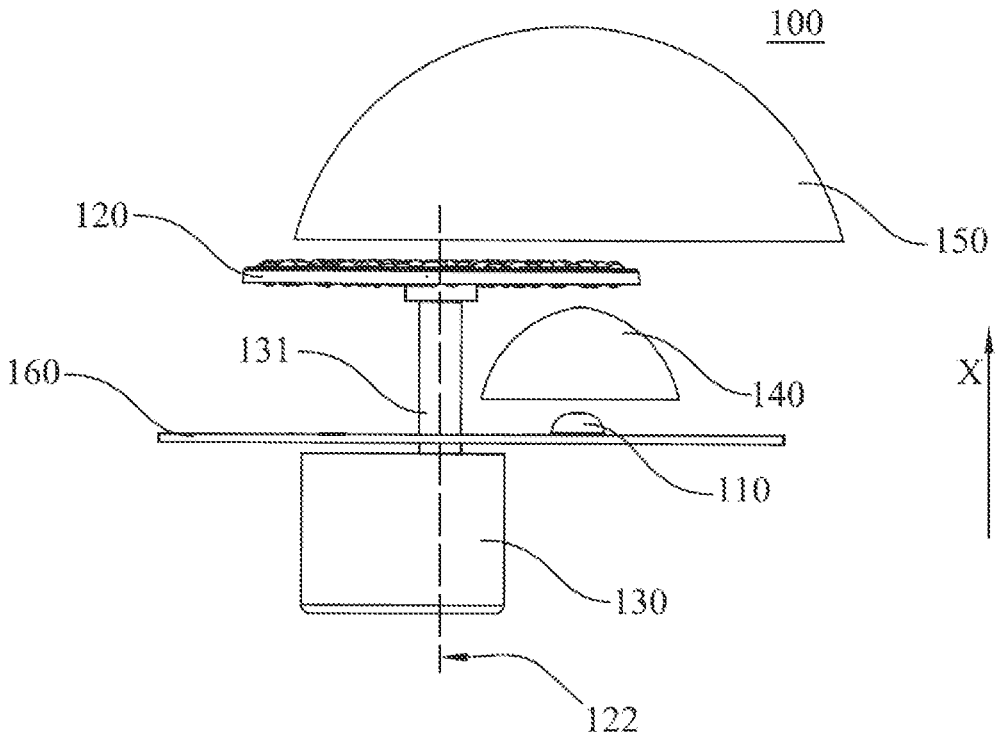
FIG. 3 is a schematic side view of the light emitting assembly according to the first embodiment of the present disclosure.
Figure 4:
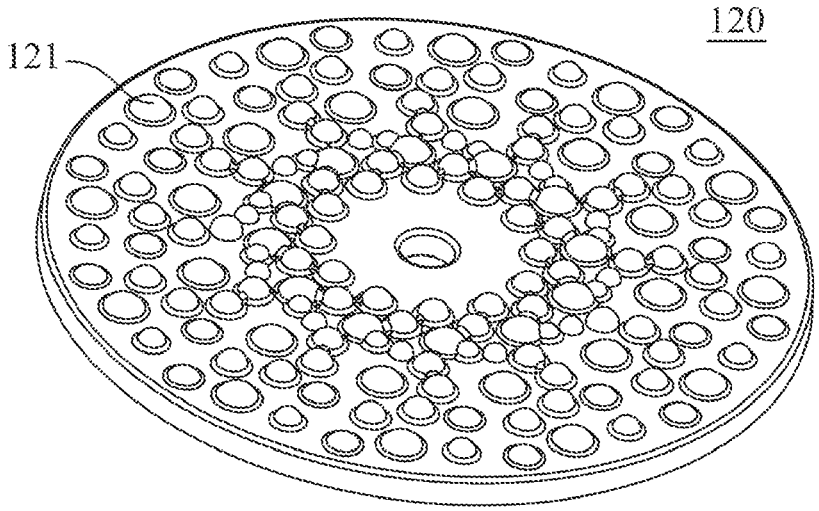
FIG. 4 is a schematic perspective view of a first light transmission portion according to the first embodiment of the present disclosure.

In order to facilitate the understanding of the present disclosure, the present disclosure will be described in more detail below with reference to accompanying drawings and specific embodiments. It should be noted that when an element is referred to as being "fixed to" another element, it can be directly on the other element, or one or more intervening elements may present therebetween. When an element is referred to as being "connected" to another element, it can be directly connected to the other element, or one or more intervening elements may present therebetween. Terms "vertical", "horizontal", "left", "right" and similar expressions used in the specification are only for illustrative purposes.

Unless otherwise defined, all technical and scientific terms used in the specification have the same meaning as commonly understood by those ordinarily skilled in the technical field belonging to the present disclosure. The terms used in the specification of the present disclosure are only for the purpose of describing specific embodiments, and are not intended to limit the present disclosure. As used in the specification, the term "and/or" includes any and all combinations of one or more of the associated listed items.

With reference to FIG. 1 to FIG. 5, a first embodiment of the present disclosure provides a light emitting assembly 100. The light emitting assembly 100 includes a first light emitting element 110, a first light transmission portion 120 and a driving portion 130.

The first light emitting element 110 is configured to generate a first light beam. The first light beam may be a concentric light beam or a parallel light beam, When the first light beam is the concentric light beam, the first light emitting element 110 emits light towards a plurality of different directions. When the first light beam is the parallel light beam, the first light emitting element 110 emits light in a single direction. The number of the first light emitting elements 110 may be one or more (two or more), and parameters such as a color temperature and a hue of the light emitted from the first light emitting element 110 may be determined according to specific requirements. When the number of the first light emitting elements 110 is multiple, the parameters such as the color temperature or the brightness of the light emitted from the first light emitting elements 110 may be identical or different. In this embodiment, the number of the first light emitting element 110 is one, the first light emitting element 110 emits the concentric light beam, and the first light emitting element 110 can emit white light.

The first light transmission portion 120 is at least partially disposed within a propagation path of the first light beam, such that the first light beam emitted from the first light emitting element 110 passes through at least one part of the first light transmission portion 120. In this embodiment, the first light beam emitted from the first light emitting element 110 passes through one part of the first light transmission portion 120 (the first light beam does not pass through all the positions of the first light transmission portion 120), and the first light beam emitted from the first light emitting element 110 completely passes through the first light transmission portion 120.

In other embodiments, the first light beam emitted from the first light emitting element 110 may pass through all the portions of the first light transmission portion 120. Alternatively, only some parts of the first light beam emitted from the first light emitting element 110 may pass through the first light transmission portion 120, and the rest of the first light beam may not pass through the first light transmission portion 120.

In this embodiment, the first light beam emitted from the first light emitting element 110 can present a predetermined pattern after passing through the first light transmission portion 120. That is, the first light beam after passing through the first light transmission portion 120 can irradiate the surface of an external object, thereby presenting the predetermined pattern. In this embodiment, the first light beam after passing through the first light transmission portion 120 can irradiate a surface of a component such as a wall and a curtain, so as to present the predetermined pattern on the wall or the curtain. For convenience of description, an example in which the first light beam irradiates the wall is taken for illustration.

The pattern presented by the first light beam is defined by a structure of the first light transmission portion 120 or a relative position of the first light transmission portion 120 and the first light emitting element 110. It should be understood that when the structure of the first light transmission portion 120 is different, the pattern presented by the first light beam is different. When the relative position of the first light transmission portion 120 and the first light emitting element 110 is different, the pattern presented by the first light beam is different. In this embodiment, the first light emitting element 110 and the first light transmission portion 120 project different patterns by making the relative position different. When the first light emitting element 110 and the first light transmission portion 120 are in the first relative position, the first light emitting element 110 can project the first pattern on the wall after passing through the first light transmission portion 120. When the first light emitting element 110 and the first light transmission portion 120 are in the second relative position, the first light emitting element 110 can project a second pattern on the wall after passing through the first light transmission portion 120. The first pattern is different from the second pattern.

In particular, two patterns are considered as different when at least one parameter such as colors, patterns, sizes, brightness, and arrangement positions of the two patterns is different. The first pattern and the second pattern may be different only in color, only in pattern, only in size, only in brightness, or only in projection position, or in any combination of the above. In this embodiment, the projection positions of the first pattern and the second pattern are identical, and the patterns projected on the wall by the first pattern and the second pattern are different.

The driving portion 130 is configured to drive the first light emitting element 110 or the first light transmission portion 120, such that the first light emitting element 110 and the first light transmission portion 120 have different relative positions from each other. In this embodiment, the driving portion 130 is connected to the first light transmission portion 120, such that the driving portion 130 can drive the first light transmission portion 120 to move relative to the first light emitting element 110, thereby enabling the first light emitting element 110 and the first light transmission portion 120 to be switched between a first relative position and a second relative position.

In particular, the driving portion 130 can drive the first light transmission portion 120 to rotate relative to the first light emitting element 110. When the driving portion 130 drives the first light transmission portion 120 to rotate to a first position, the first light transmission portion 120 and the light emitting element 110 has the first relative position. When the driving portion 130 drives the first light transmission portion 120 to rotate to a second position, the first light transmission portion 120 and the first light emitting element 110 have the second relative position.

In this embodiment, the driving portion 130 can drive the first light transmission portion 120 to move to other positions, such that the first light transmission portion 120 and the first light emitting element 110 have other relative positions (other relative positions are relative positions except for the first relative position and the second relative position); and when the first light transmission portion 120 and the first light emitting element 110 are in other relative positions, the first light beam emitted from the first light emitting element 110 passes through the first light transmission portion 120 and can present other patterns after projecting to the wall (the other patterns are different patterns from the first pattern and the second pattern).

In the light emitting assembly 100 provided in this embodiment, the first light beam generated by the first light emitting element 110 can irradiate the wall after passing through the first light transmission portion 120, and projecting two different patterns, that is, the first pattern and the second pattern, on the wall. The light emitting assembly 100 further includes a driving portion 130, wherein the driving portion 130 can drive the first light transmission portion 120 to rotate relative to the first light emitting element 110, such that the first light emitting element 110 and the first light transmission portion 120 can be in the first relative position or the second relative position, and the first light emitting element 110 and the first light transmission portion 120 may be switched between the first relative position and the second relative position. When the first light transmission portion 120 and the first light emitting element 110 are in the first relative position, the first light beam passing through the first light transmission portion 120 can present a first pattern. When the first light transmission portion 120 and the first light emitting element 110 are in the second relative position, the first light beam passing through the first light transmission portion 120 can present a second pattern different from the first pattern. This enables the light emitting element to project at least two different patterns to the outside, which enriches the luminous effect of the light emitting assembly 100 and enables the light emitting assembly 100 to adapt to different usage scenarios or atmospheres.

Since the first light emitting element 110 needs to be electrically connected with a power supply, and a conductive wire is connected between the first light emitting element 110 and the power supply, the conductive wire moves along with the first light emitting element 110 when the first light emitting element 110 moves, which easily makes the conductive wire fail. In this embodiment, the driving portion 130 is connected to the first light transmission portion 120 and configured to drive the first light transmission portion 120 to rotate relative to the first light emitting element 110. Compared with a solution in which the driving portion 130 is connected with the first light emitting element 110 and drives the first light emitting element 110 to move relative to the driving portion 130, a solution in which the driving portion 130 is connected with the first light transmission portion 120 can reduce the failure rate of the light emitting assembly 100, and prolong the service life of the light emitting assembly 100.

In other embodiments, the driving portion 130 can drive the first light transmission portion 120 to translate relative to the first light emitting element 110, such that the first light emitting element 110 and the first light transmission portion 120 can have a first relative position and a second relative position. In particular, the driving portion 130 can drive the first light transmission portion 120 to move along a straight line or a curved line relative to the first light emitting element 110.

In other embodiments, the driving portion 130 may be connected to the first light emitting element 110, and the driving portion 130 can drive the first light emitting element 110 to move relative to the first light transmission portion 120, such that the first light emitting element 110 and the first light transmission portion 120 may have a first relative position and a second relative position. In particular, the driving portion 130 can drive the first light emitting element 110 to move or rotate relative to the first light transmission portion 120.

In other embodiments, the driving portion 130 may be connected to both the first light emitting element 110 and the first light transmission portion 120, and the driving portion 130 can simultaneously drive the first light emitting element 110 and the first light transmission portion 120 to move, such that the light emitting element 110 and the first light transmission portion 120 can have a first relative position and a second relative position. In particular, the driving portion 130 can drive the first light emitting element 110 to move or rotate relative to the first light transmission portion 120, and the driving portion 130 can drive the first light transmission portion 120 to move or rotate relative to the first light emitting element 110.

A specific structure of the first light transmission portion 120 for presenting the first pattern or the second pattern is determined according to specific requirements. In this embodiment, the first light transmission portion 120 includes a plurality of first lens units 121, wherein each of the first lens units 121 can converge or diverge a first light beam. That is, the first lens units 121 may be of a convex lens structure or a concave lens structure or the like. The first light transmission portion 120 is configured to refract the first light beam through each of the first lens units 121, such that the first light beam passing through the first light transmission portion 120 presents a first pattern or a second pattern. Different regions of the pattern projected on the wall by the first light beam after passing through the first lens units 121 present a brightening or dimming effect (when the first lens units 121 is of a convex lens structure, the corresponding region is brightened; and when the first lens units 121 is of a concave lens structure, the corresponding region is dimmed), such that the first light beam presents a shading variation in various positions of the pattern on a projecting surface, and then presents the desired effect of the pattern by means of the shading variation.

When the first light emitting element 110 and the first light transmission portion 120 move to the first relative position, the first light beam emitted from the first light emitting element 110 passes through a part of the first light transmission portion 120, such that the first light beam can present a first shading-varying pattern, wherein the first shading-varying pattern is the first pattern. When the first light emitting element 110 and the first light transmission portion 120 move to the second relative position, the first light beam emitted from the first light emitting element 110 passes through another part of the first light transmission portion 120, such that the first light beam can present a second shading-varying pattern, wherein the second shading-varying pattern is the second pattern. Various parts of the second pattern and the first pattern have different shading relationships and different pattern styles.

In this embodiment, the first lens units 121 is of a regular hemispherical lens structure, and a plurality of the first lens units 121 are discretely distributed on parts of the first light transmission portion 120. In this embodiment, some of the first lens units 121 exists independently, and the rest of the first lens units overlaps with each other.

Figure 5:
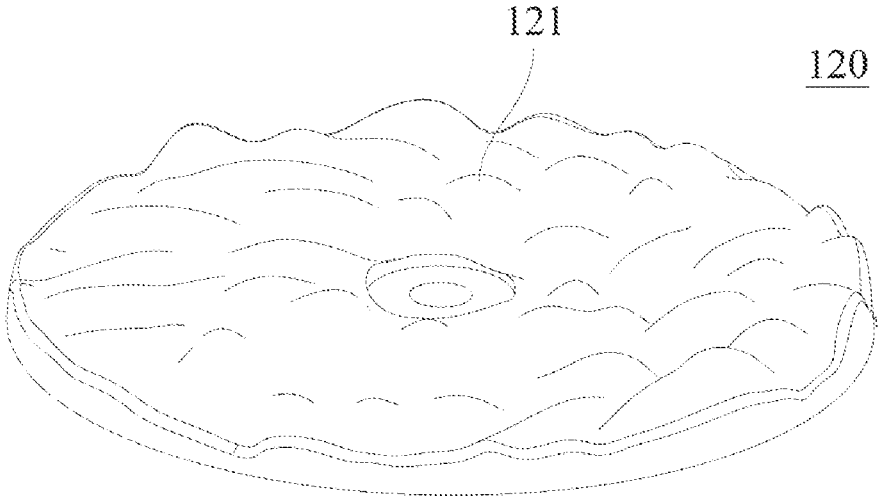
FIG. 5 is a schematic perspective view of another alternative solution of the first light transmission portion of the light emitting assembly according to the first embodiment of the present disclosure.

With reference to FIG. 5, in other embodiments, the first lens unit 121 may be of an irregular convex lens structure, and a plurality of the first lens units 121 are discretely distributed on parts of the first light transmission portion 120.

In this embodiment, the first light transmission portion 120 may be configured to present a starry sky pattern by means of the adjustment of the first lens units 121, and the starry sky pattern may include patterns such as stars, nebulae, or galaxy groups. When the first light transmission portion 120 moves relative to the first light emitting element 110, effects of moving stars, nebulae, or galaxy groups may be presented on the wall.

In other embodiments, the first light transmission portion 120 may be configured to present an ocean wave pattern. When the first light transmission portion 120 moves relative to the first light emitting element 110, a moving ocean wave effect may be presented on the wall.

In this embodiment, the first light emitting element 110 and the first light transmission portion 120 may have more than two relative positions for projecting patterns. Moreover, in a process of switching the first light transmission portion 120 and the first light emitting element 110 from the first relative position to the second relative position, the pattern which can be presented by the first light beam passing through the first light transmission portion 120 gradually changes from the first pattern to the second pattern. In other words, in the process of switching the first light transmission portion 120 and the first light emitting element 110 from the first relative position to the second relative position, the first light beam can project a pattern on the wall in real time, and the projected pattern gradually changes. When the first light transmission portion 120 and the first light emitting element 110 move relatively, the pattern can be displayed on the projecting surface in real time, and the pattern changes in real time, such that the projection effect of the light emitting assembly 100 is better.

In other embodiments, the first light transmission portion 120 may present a predetermined pattern in a fashion of blocking a part of the first light beam. Exemplarily, the first light transmission portion 120 may include a light shielding plate, wherein the light shielding plate is provided with a light transmission hole of a predetermined shape (light can only pass through the first light transmission portion 120 via the light transmission hole). For example, the shape of the light transmission hole may be triangle or circle. The first light beam can present a triangular or circular pattern on the wall or the curtain after passing through the first light transmission portion 120. Certainly, when the shape of the light transmission hole is a figure painting or a landscape painting, the first light beam can correspondingly present the figure painting or the landscape painting on the wall or curtain.

In other embodiments, the first light transmission portion 120 may further be provided with a light transmission layer, wherein the light transmission layer has a preset color, shape, and light transmittance. For example, the light transmission layer may be a red translucent layer in a circular shape. The first light beam can project a circular red pattern on the wall after passing through the first light transmission portion 120.

In other embodiments, the first light emitting element 110 and the first light transmission portion 120 may only have two relative positions (i.e., the first relative position and the second relative position) for projecting patterns. In this case, when the first light emitting element 110 and the first light transmission portion 120 are only in the first relative position or the second relative position, the first light beam can present a pattern. When the first light emitting element 110 and the first light transmission portion 120 are in other different relative positions, the first light beam is incapable of presenting a pattern. Exemplarily, the first light transmission portion 120 may include a light shielding sheet, wherein the light shielding sheet is provided with a first light transmission hole and a second light transmission hole, the first light transmission hole is circular, and the second light transmission hole is square. When the first light emitting element 110 and the first light transmission portion 120 are in the first relative position, the first light transmission hole faces the first light emitting element 110, such that the first light beam can present a circular pattern. When the first light emitting element 110 and the first light transmission portion 120 are in the second relative position, the second light transmission hole faces the first light emitting element 110, such that the first light beam can present a square pattern. When the first light transmission portion 120 moves from a position where the first light transmission hole faces the first light emitting element 110 to a position where the second light transmission hole faces the first light emitting element 110, the first light beam is completely shielded by the first light shielding sheet, and in this process, the first light beam is incapable of projecting a pattern to the outside.

In order to make the light beams passing through the first light transmission portion 120 have a relatively uniform emission direction, in this embodiment, the light emitting assembly 100 further includes a first condensing lens 140, wherein the first condensing lens 140 is disposed between the first light emitting element 110 and the first light transmission portion 120, the first condensing lens 140 is configured to converge the first light beam propagating to the first light transmission portion 120. The light beam passing through the first condensing lens 140 can be converged into the same direction, such that the propagation direction of the light beam passing through the first condensing lens 140 tends to be more uniform.

In this embodiment, the first condensing lens 140 is a convex lens, and the first light beam propagates in a converged state after passing through the first condensing lens 140. The first condensing lens 140 can convert and transmit the first light beam to the first light transmission portion 120, such that the first light beam can be more accurately transmitted by the set position of the first light transmission portion 120.

After the first light beam passes through the first light transmission portion 120, the propagation direction of the first light beam may be in a scattered state. In view of this, in the present embodiment, the light emitting assembly 100 further includes a second condensing lens 150, wherein the second condensing lens 150 is disposed on one side of the first light transmission portion 120 away from the first light emitting element 110; and the second condensing lens 150 is configured to converge the first light beam passing through the first light transmission portion 120, so as to converge the light beam passing through the first condensing lens 140 into a projecting surface such as an external wall or a curtain.

In this embodiment, the driving portion 130 drives the first light transmission portion 120 to rotate relative to the first light emitting element 110. The first light emitting element 110 and the first light transmission portion 120 are arranged along a first direction X. The driving portion 130 drives the first light transmission portion 120 to rotate in a direction around a first axis 122, wherein the first axis 122 is parallel to the first direction X. In particular, the first light transmission portion 120 may be in a shape of a fiat plate, and the first axis 122 is perpendicular to the wall surface of the first light transmission portion 120 facing the first light emitting element 110. In this embodiment, the first light transmission portion 120 and the first light emitting element 110 have compact structures, and the space occupied by the first light transmission portion 120 is small.

The applicant found that when the first light transmission portion 120 rotates in the direction around the first axis 122, as viewed in the first direction X, the smaller the distance between the first light emitting element 110 and the first axis 122 is, the faster the pattern projected on the projecting surface by the first light beam passing through the first light transmission portion 120 moves. The greater the distance between the first light emitting element 110 and the first axis 122 is, the slower the pattern projected on the projecting surface by the first light beam passing through the first light transmission portion 120 moves. In order to enable the light emitting assembly 100 to have a better projection effect, in this embodiment, as viewed in the first direction X, the first light emitting element 110 is arranged offset from the first axis 122, that is, the first axis 122 does not pass through the first light emitting element. In this way, the pattern projected on the projecting surface by the first light beam passing through the first light transmission portion 120 can move at a suitable speed. In addition, the first light beam passing through the first light transmission portion 120 can present a greater number of patterns.

Relative positions of the first light transmission portion 120 and the driving portion 130 are determined according to specific requirements. In this embodiment, the driving portion 130 is positioned on one side of the first light emitting element 110 away from the first light transmission portion 120. In particular, the light emitting assembly 100 further includes a first circuit board 160, wherein the first light emitting element 110 is electrically connected to the first circuit board 160, and particularly connected to the wall of the first circuit board 160 facing the first light transmission portion 120. The driving portion 130 is disposed on one side of the first circuit board 160 away from the first light transmission portion 120. In order to prevent positional interference between the first driving portion 130 and the first circuit board 160, the first circuit board 160 is provided with a first hole 161, the driving portion 130 includes a driving shaft 131, and the driving shaft 131 is engaged in the first hole 161 and connected to the first light transmission portion 120. In this solution, the driving portion 130, the first circuit board 160 and the first light transmission portion 120 have more compact structures. Moreover, compared with a structure in which the driving portion 130 is disposed between the first circuit board 160 and the first light transmission portion 120, the driving portion 130 can have a larger arrangement space.

Figure 6:
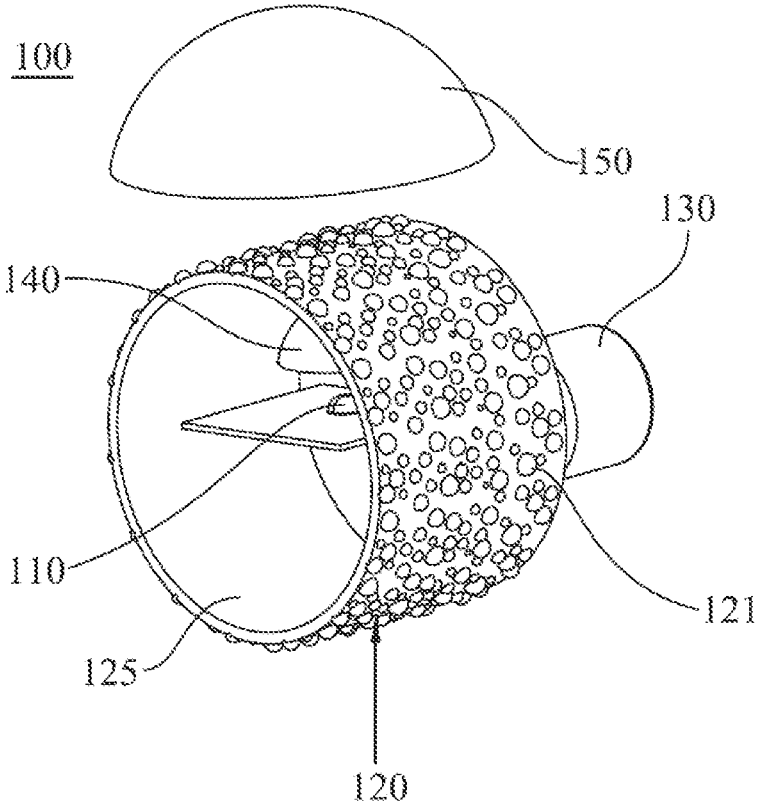
FIG. 6 is a schematic perspective view of a light emitting assembly according to a second embodiment of the present disclosure.
Figure 7:
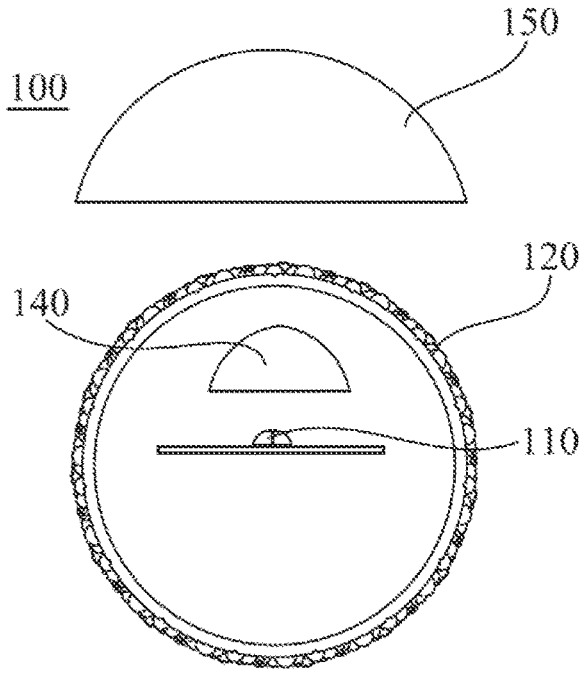
FIG. 7 is a schematic side view of the light emitting assembly according to the second embodiment of the present disclosure from a first viewing angle.
Figure 8:
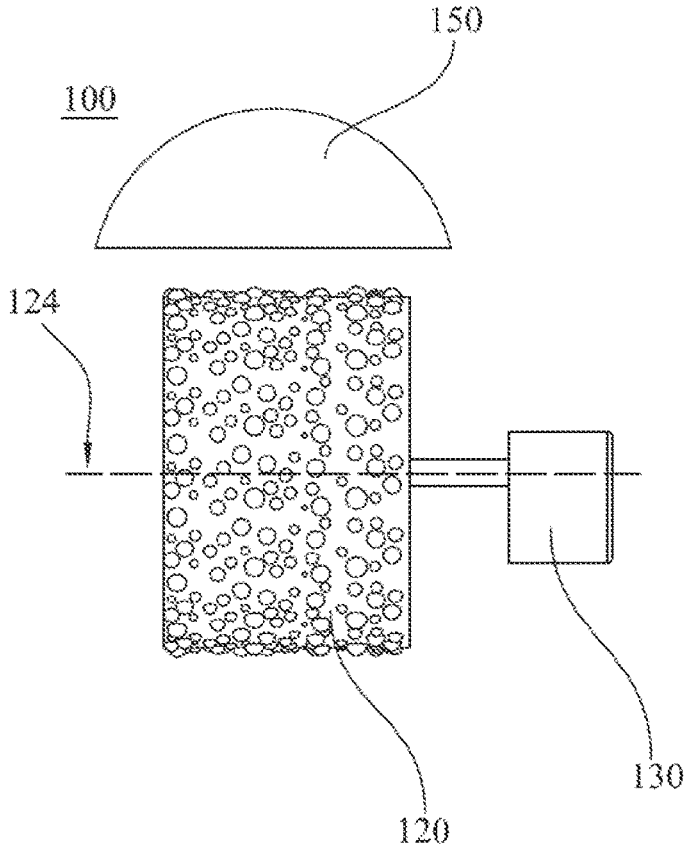
FIG. 8 is a schematic perspective view of the light emitting assembly according to the second embodiment of the present disclosure from a second viewing angle.

With reference to FIG. 6 to FIG. 8, the light emitting assembly 100 in the second embodiment of the present disclosure is shown. In this embodiment, structures of the first light emitting element 110, the first condensing lens 140 and the third condensing lens 190 are basically the same as a structure of the light emitting assembly 100 in the first embodiment. Differently, the first light transmission portion 120 includes a first peripheral wall 125 arranged around a second axis 124, and a plurality of first lens units 121 are disposed on the first peripheral wall 125. The first light emitting element 110 is disposed within the first peripheral wall 125, the first light beam passes through the first peripheral wall 125, so as to be capable of presenting the first pattern or the second pattern. The driving portion 130 is configured to drive the first light transmission portion 120 to rotate around the second axis 124.

In the light emitting assembly 100 in this embodiment, the area of a component of the first light transmission portion 120 for defining the projected patterns is larger, such that the patterns projected by the light emitting assembly 100 may be plentiful. When the first light transmission portion 120 is of the structure described above, the first condensing lens 140 may be disposed within the first peripheral wall 125, thereby facilitating that the first condensing lens 140 can propagate the first light beam emitted from the first light emitting element 110 to the first peripheral wall 125 after converging it.

Relative positions of the second axis 124 and the first light emitting element 110 are determined according to specific requirements. In this embodiment, the second axis 124 passes through the first light emitting element 110. In this solution, when the first peripheral wall 125 rotates around the second axis 124, a distance between a site of the first peripheral wall 125 directly in front of the second light emitting element 170 for transmitting the first light beam and the second light emitting element 170 is constant, such that the pattern projected on the wall by the second light beam will not greatly deform during movement, and the projection effect of the light emitting assembly 100 is better.

Figure 9:
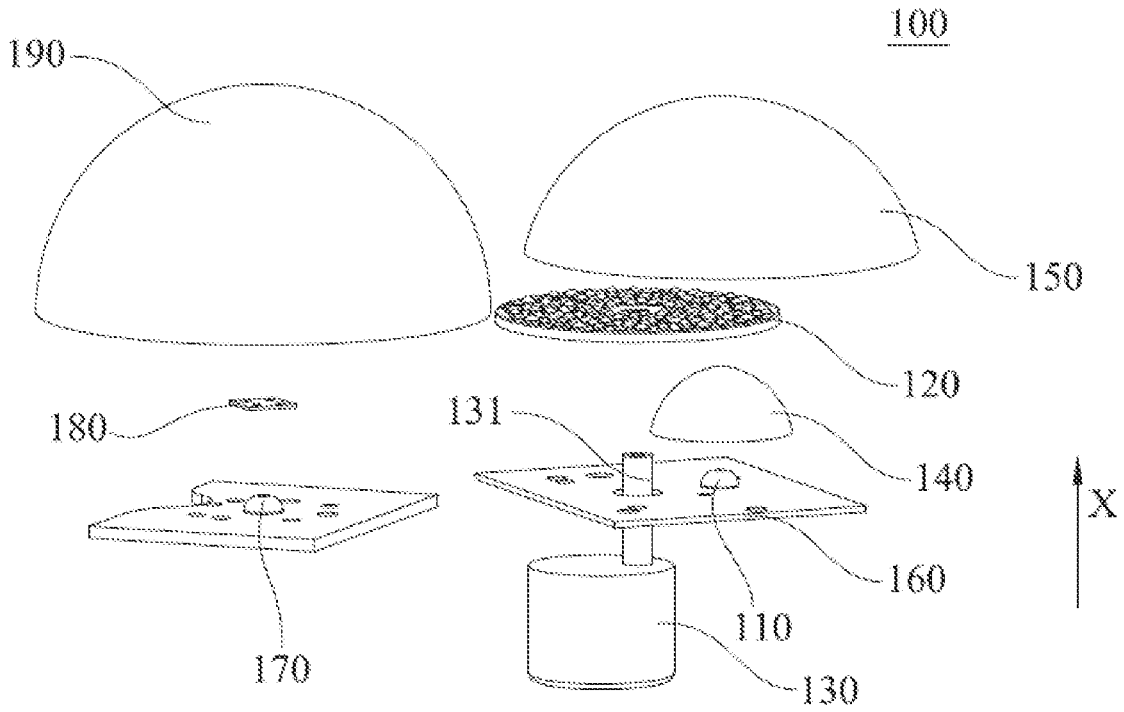
FIG. 9 is an exploded schematic view of a light emitting assembly according to a third embodiment of the present disclosure.
Figure 10:
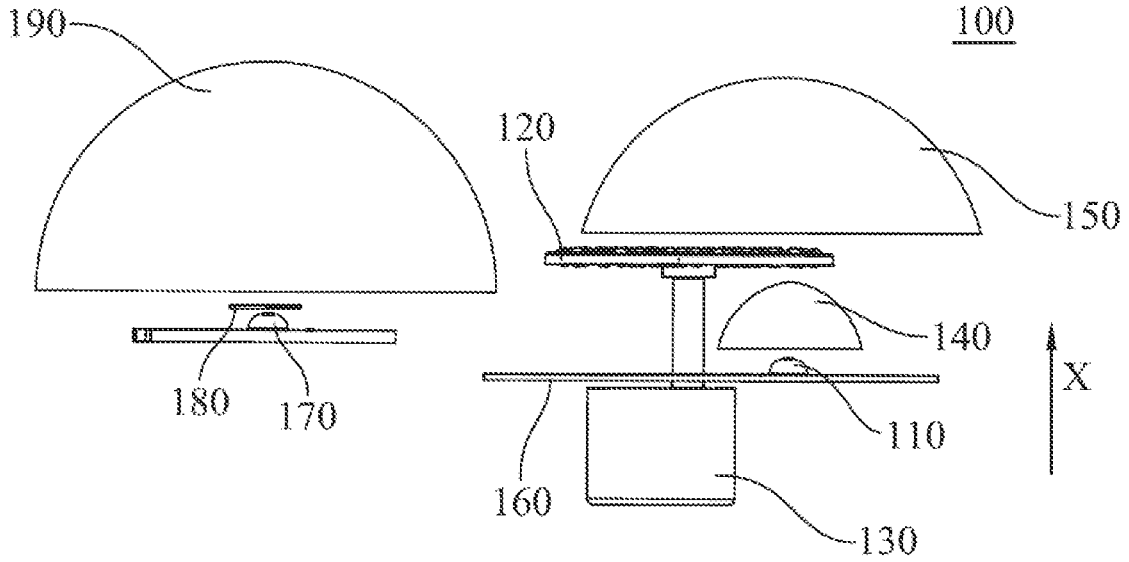
FIG. 10 is a schematic side view of the light emitting assembly according to the third embodiment of the present disclosure.
Figure 11:
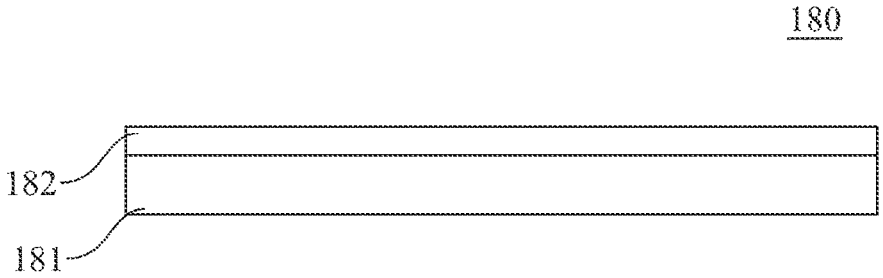
FIG. 11 is a schematic side view of a second light transmission portion of the light emitting assembly according to the third embodiment of the present disclosure.

With reference to FIG. 9 to FIG. 11, the light emitting assembly 100 in the third embodiment of the application is shown. The light emitting assembly 100 in this embodiment includes the light emitting assembly 100 in the first embodiment. The light emitting assembly 100 in this embodiment may further include a second light emitting element 170 and a second light transmission portion 180.

The second light emitting element 170 is configured to generate a second light beam. The second light transmission portion 180 is at least partially disposed within a propagation path of the second light beam. The second light beam can present a third pattern after passing through the second light transmission portion 180. In this embodiment, the second light beam emitted from the second light emitting element 170 passes through all the positions of the second light transmission portion 180, and the second light beam emitted from the second light emitting element 170 all passes through the second light transmission portion 180.

In other embodiments, the second light beam emitted from the second light emitting element 170 may pass through a part of the second light transmission portion 180, and the second light beam emitted from the second light emitting element 170 may only partially pass through the second light transmission portion 180.

The third pattern presented on the wall by the second light beam passing through the second light transmission portion 180 can be the same as the first pattern or the second pattern, and the third pattern presented on the wall by the second light beam passing through the second light transmission portion 180 may be different from both the first pattern and the second pattern. In this embodiment, the third pattern is different from both the first pattern and the second pattern.

The second light transmission portion 180 and the first light transmission portion 120 may have identical or different light transmission principles. Particularly, in this embodiment, the second light transmission portion 180 defines the second pattern in a fashion of shielding the second light beam. The second light transmission portion 180 includes a base material layer 181 and a pattern layer 182, wherein the pattern layer 182 defines the third pattern. That is, the pattern layer 182 is provided with a pattern capable of transmitting light. After the second light beam passes through the pattern layer 182, the pattern on the pattern layer 182 can be amplified onto the projecting surface.

A projection direction of the second light beam may be identical to or different from a projection direction of the first light beam. When the projection direction of the second light beam is identical to the projection direction of the first light beam, the pattern projected on the projecting surface by the second light beam may or may not be coincident with the pattern projected on the projecting surface by the first light beam. In this embodiment, in order to match the pattern presented by the second light beam with the pattern presented by the first light beam, the projection direction of the second light beam is identical to the projection direction of the first light beam, and the pattern projected on the wall by the second light beam at least partially overlaps with the pattern projected on the wall by the first light beam. In other words, the light beam emitted from the light emitting assembly 100 to the outside is configured to project a fourth pattern on the wall, and the fourth pattern includes the first pattern and the third pattern described above (when the first light transmission portion 120 and the first light emitting portion element 110 are in the first relative position). The first pattern at least partially overlaps with the third pattern. In this embodiment, the first pattern covers the third pattern. In this solution, the first pattern and the third pattern can be made to correspond to each other, so as to enhance the projection effect.

In other embodiments, the projection direction of the second light beam may be different from the projection direction of the first light beam. Moreover, when the first light emitting element 110 and the first light transmission portion 120 are in the first relative position, the first pattern and the third pattern may be in different positions on the wall, and do not coincide.

In this embodiment, the third pattern may be a starry sky pattern or a pattern such as a figure and an animal by the sea. In this embodiment, the third pattern is used to present a star pattern, and the first pattern and the second pattern are used to present a nebula or a galaxy group. When the first light transmission portion 120 moves relative to the first light emitting assembly 100, the effect of the pattern displayed on the wall is an effect of the nebula or the galaxy group moving around stars.

In this embodiment, the first light beam is used to project a moving pattern on the wall, and the second light beam is used to present a fixed pattern on a wall projecting surface. By means of the combination of the two patterns, the light emitting assembly 100 can present a better luminous effect.

In this embodiment, the light emitting assembly 100 further includes a third condensing lens 190, wherein the third condensing lens 190 is disposed on one side of the second light transmission portion 180 away from the second light emitting element 170, and the third condensing lens 190 is configured to converge the second light beam passing through the second light transmission portion 180, such that the second light beam passing through the second light transmission portion 180 can project towards a specified direction. In particular, the third condensing lens 190 may be a convex lens.

In order to project a plurality of third patterns, in this embodiment, a plurality of second light emitting elements 170 and second light transmission portions 180 are provided, and light emitted from each of the second light emitting elements 170 passes through each of the second light transmission portion 180 in a one-to-one correspondence, such that a plurality of third patterns can be presented on the projecting surface.

Figure 12:
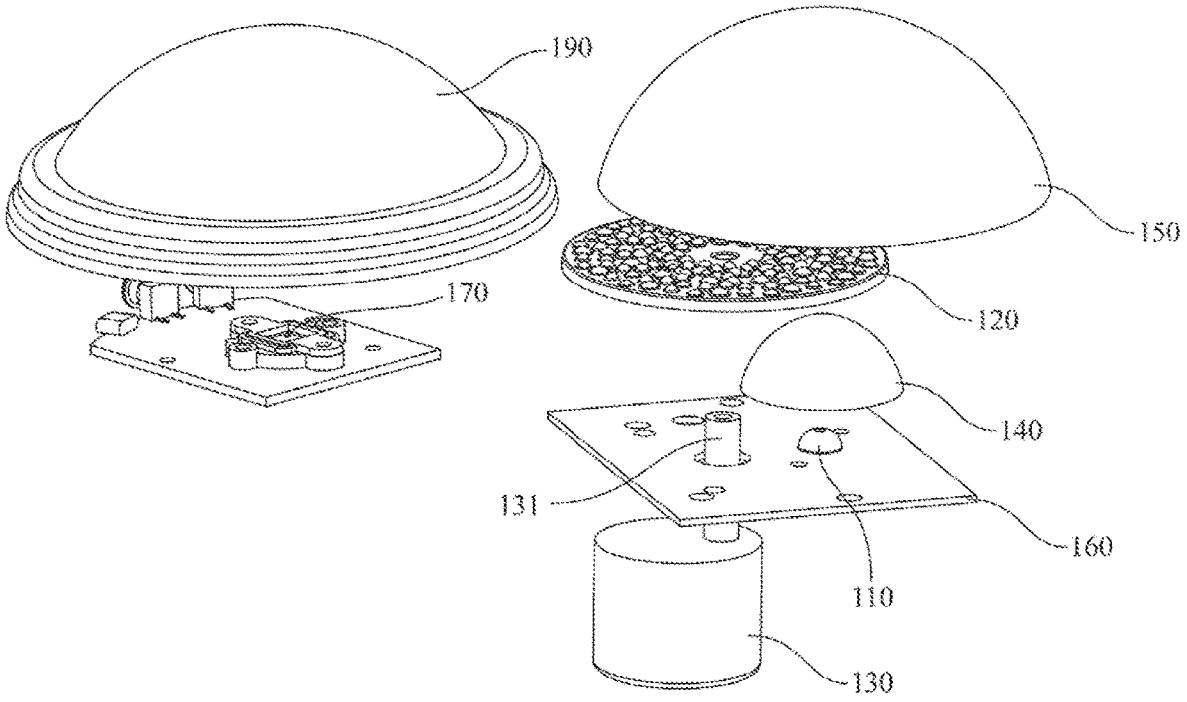
FIG. 12 is a schematic perspective view of a light emitting assembly according to a fourth embodiment of the present disclosure.
Figure 13:
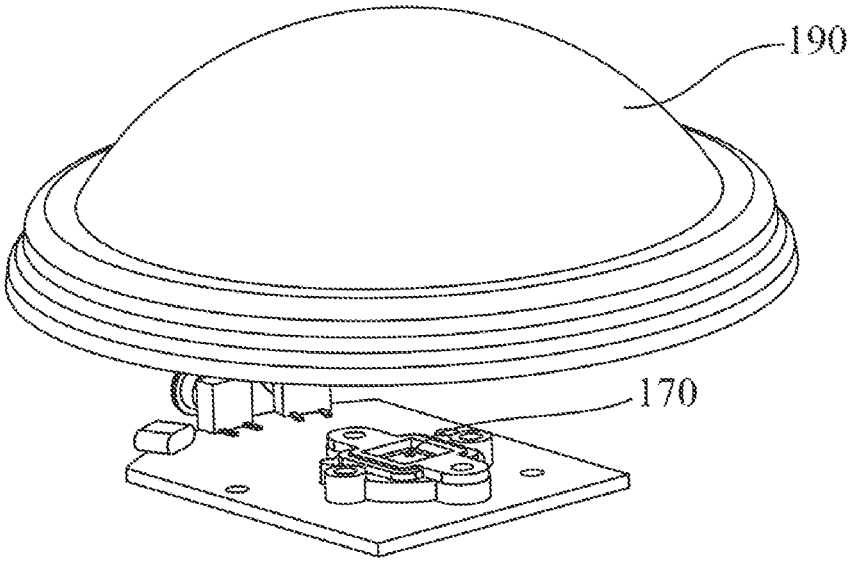
FIG. 13 is a schematic perspective view of a combination of structures such as a third condensing lens and a second light reflecting element of the light emitting assembly according to the fourth embodiment of the present disclosure from a first viewing angle.
Figure 14:
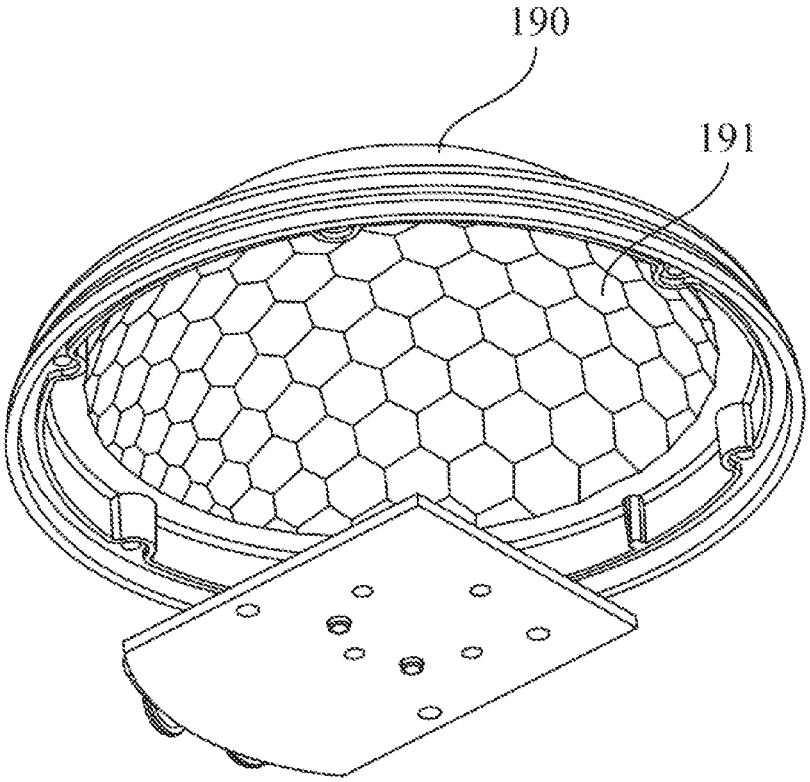
FIG. 14 is a schematic perspective view of the combination of the structures such as the third condensing lens and the second light emitting element of the light emitting assembly according to the fourth embodiment of the present disclosure from a second viewing angle.
Figure 15:
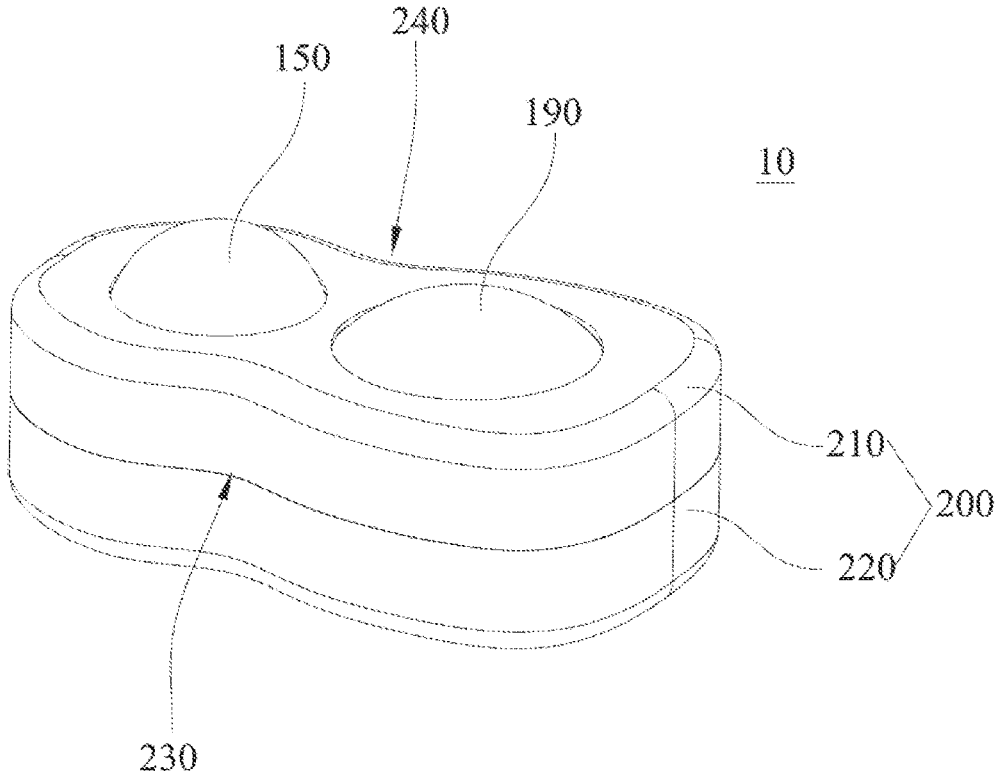
FIG. 15 is a schematic perspective view of a light emitting device according to a fifth embodiment of the present disclosure.
Figure 16:
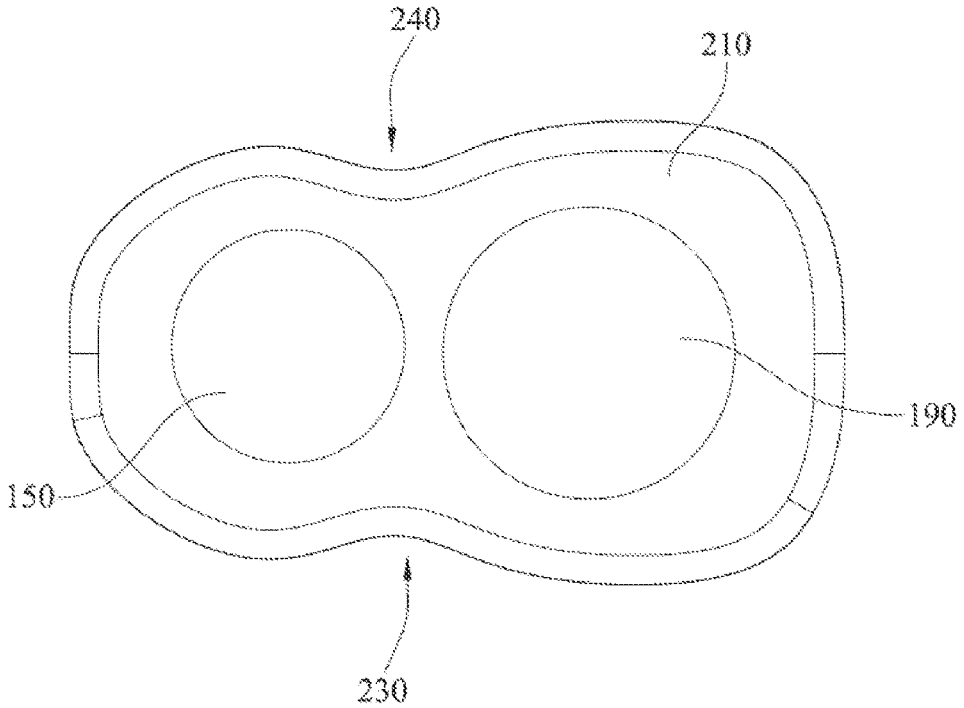
FIG. 16 is a schematic top view of the light emitting device according to a fifth embodiment of the present disclosure.
Figure 17:
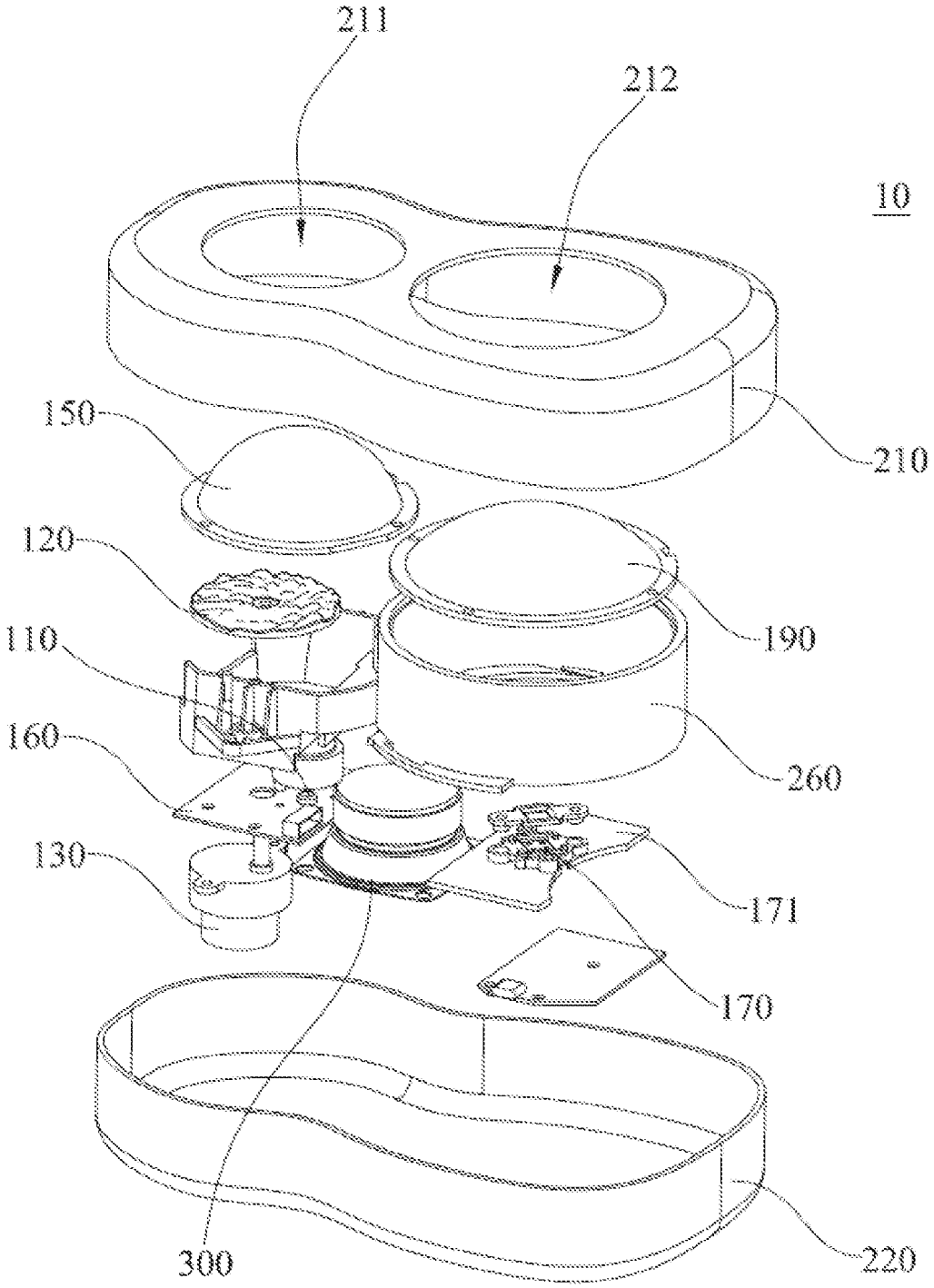
FIG. 17 is an exploded schematic view of the light emitting device according to the fifth embodiment of the present disclosure viewed from a direction.
Figure 18:
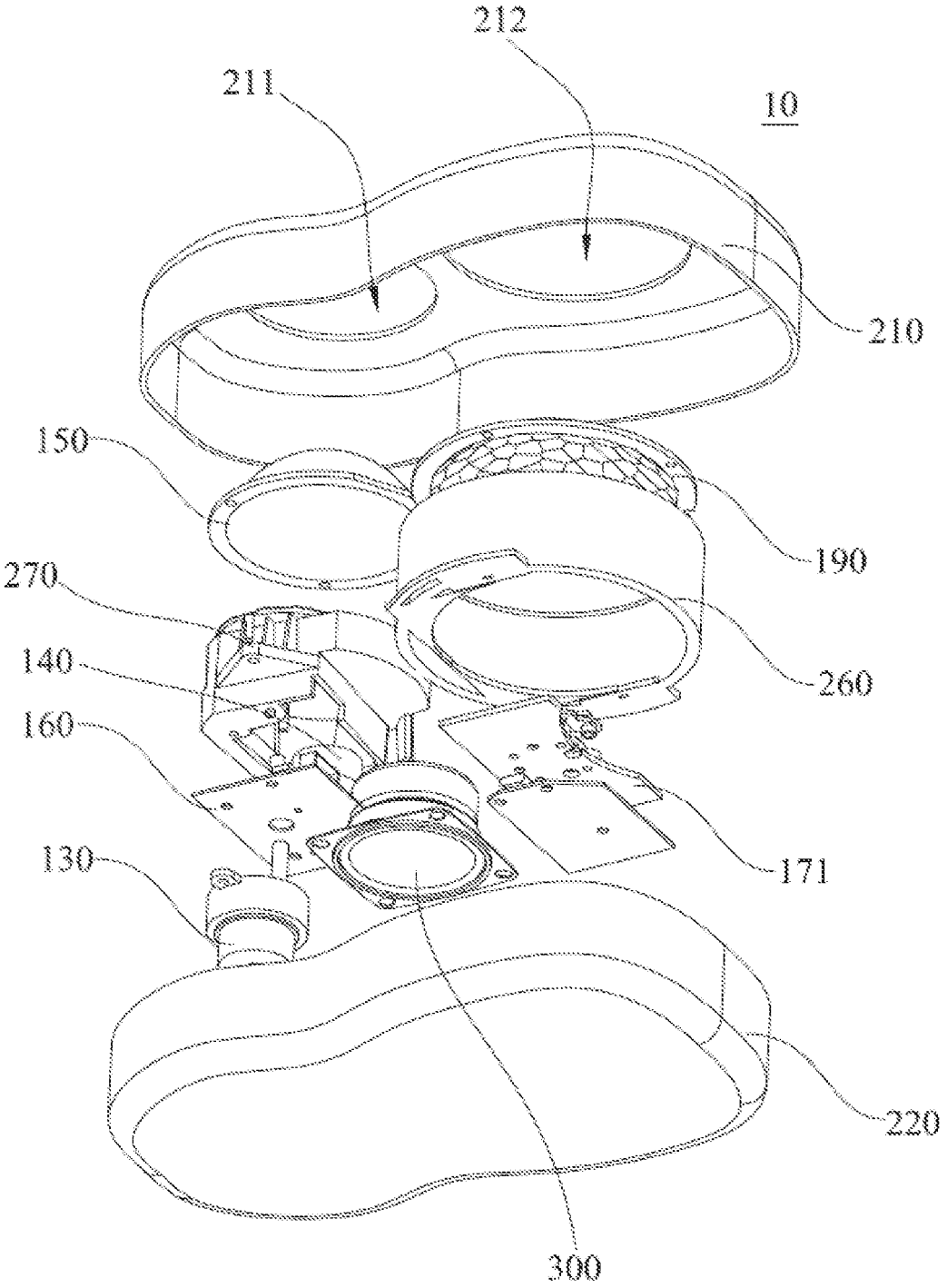
FIG. 18 is an exploded schematic view of the light emitting device according to the fifth embodiment of the present disclosure, viewed from a second direction.
Figure 19:
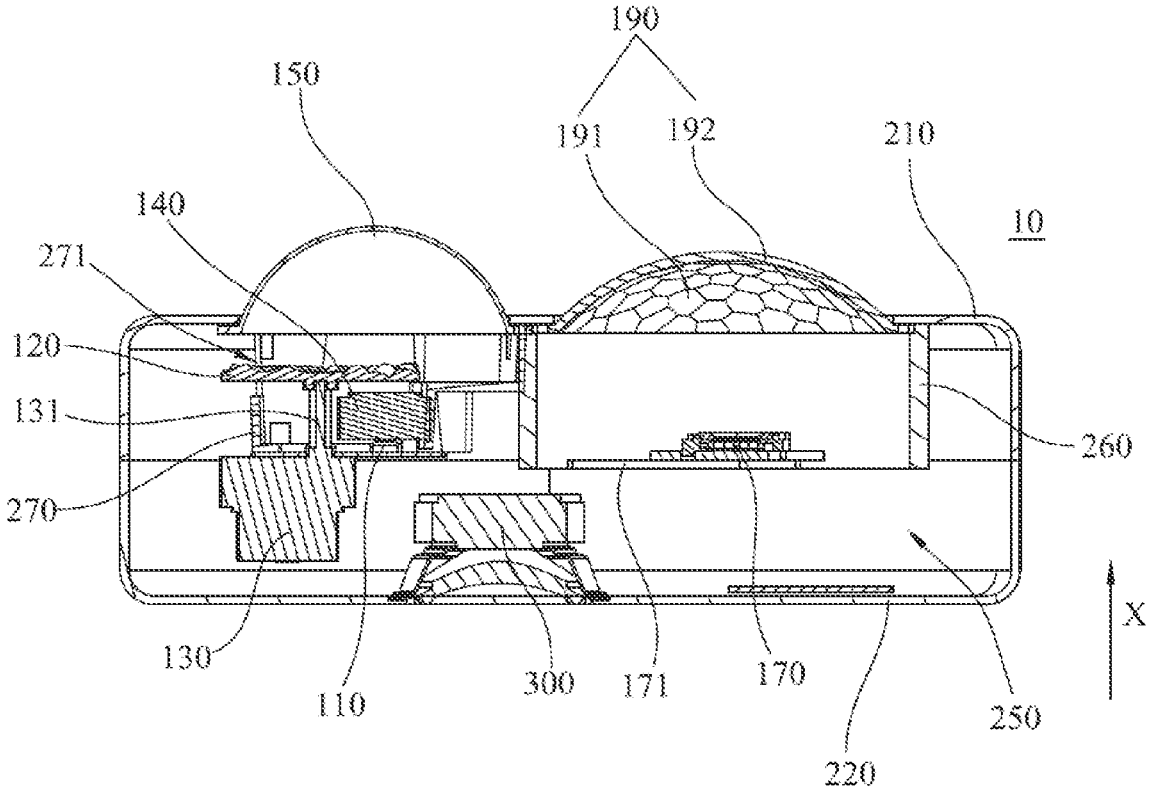
FIG. 19 is a schematic cross-section view showing the light emitting device according to the fifth embodiment of the present disclosure.
Figure 20:
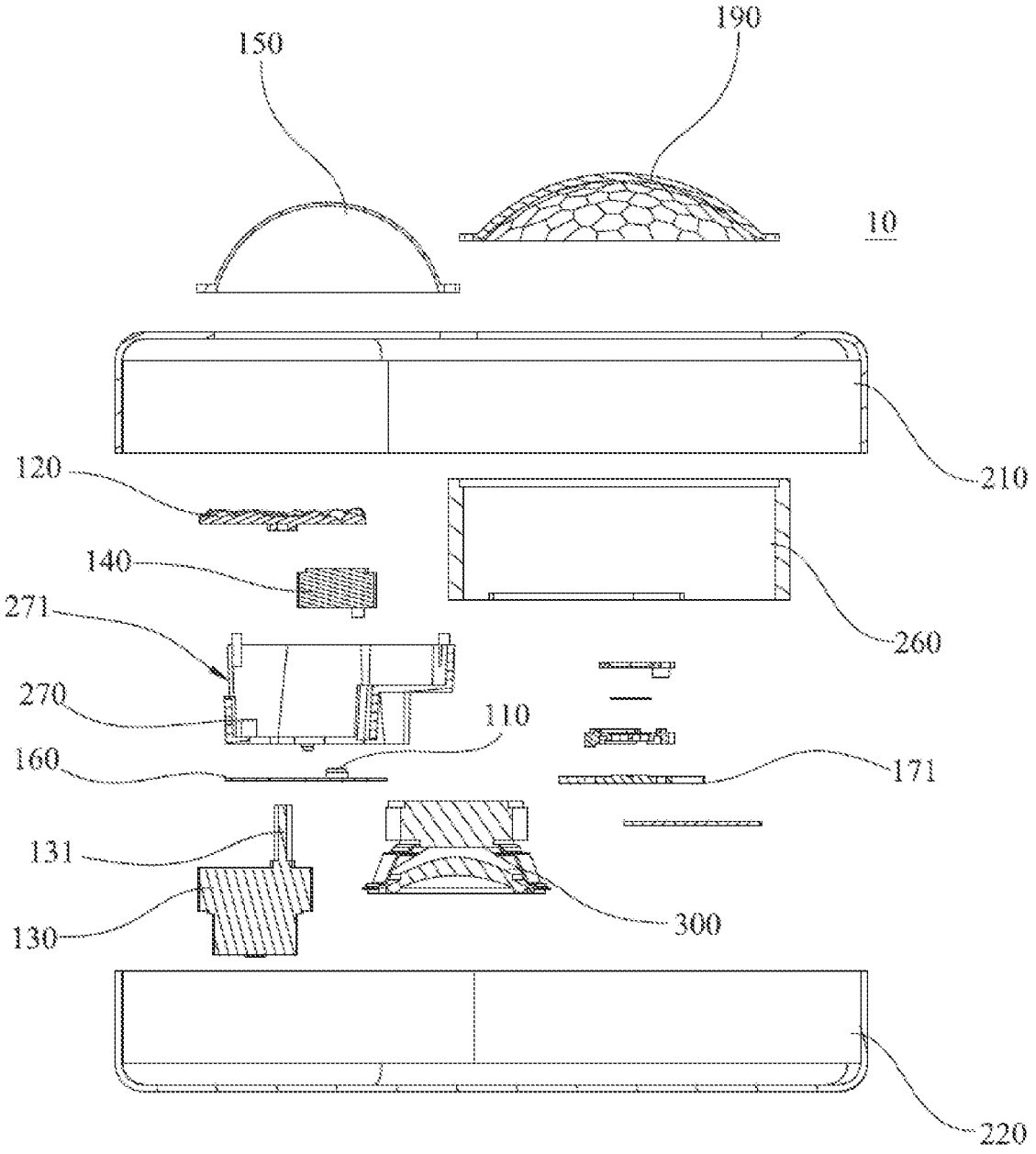
FIG. 20 is an exploded schematic cross-sectional view showing the light emitting device according to the fifth embodiment of the present disclosure.
Figure 21:
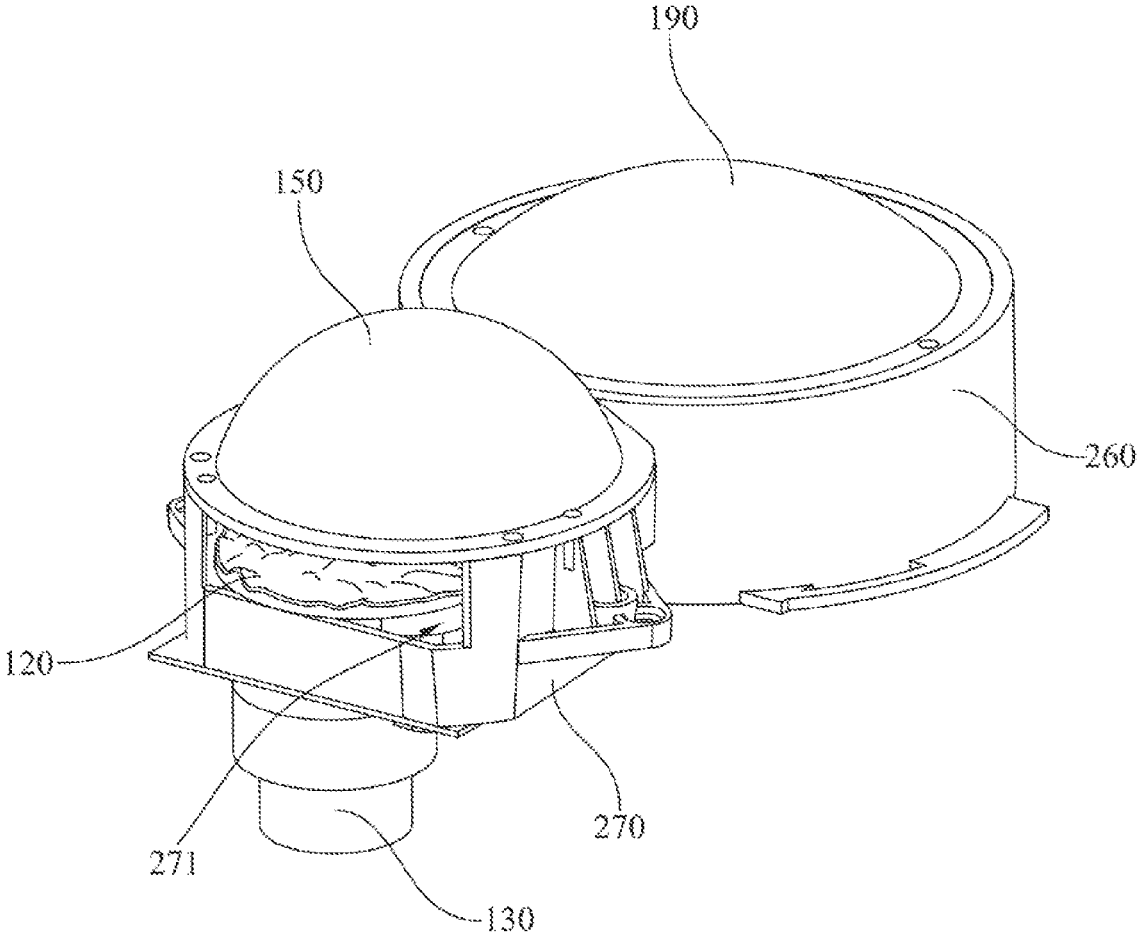
FIG. 21 is a schematic perspective view of the light emitting assembly of the light emitting device according to the fifth embodiment of the present disclosure combined with a first sleeve body and a second sleeve body.

With reference to FIG. 12 to FIG. 14, the light emitting assembly 100 provided in the fourth embodiment of the present disclosure is shown. The light emitting assembly 100 is different from the light emitting assembly 100 in the third embodiment only by the third condensing lens 190.

In particular, in this embodiment, the third condensing lens 190 includes a cover body 192 and a plurality of second lens units 191 disposed on the cover body 192, wherein each of the second lens units 191 can converge the second light beam, thereby enabling the second light beam passing through the third condensing lens 190 to present a plurality of third patterns. In other words, each of the second lens units 191 on the third condensing lens 190 can converging the light emitted from the second light emitting element 170. In this way, even if the light emitting assembly 100 only includes one second light emitting element 170 and one second light transmission portion 180, the same number of third patterns as the second lens units 191 can be projected on the projecting surface. In particular, the second lens unit 191 may be of a convex lens structure.

A second aspect of the present disclosure further provides a light emitting device 10. The light emitting device 10 may be a device capable of emitting light, such as a lighting device or a projecting device. The light emitting device 10 may include the light emitting assembly 100 in any of the above embodiments. Particularly, with reference to FIG. 15 to FIG. 21, the light emitting device 10 in this embodiment includes the light emitting assembly 100 in the fourth embodiment. The light emitting device 10 further includes a housing 200.

The housing 200 includes a first housing body 210 and a second housing body 220. After the first housing body 210 and the second housing body 220 define accommodating cavity 250 for accommodating the light emitting assembly 100 after being connected. Relative positions of the first housing body 210 and the second housing body 220 may be determined according to specific requirements, in this embodiment, the first housing body 210 and the second housing body 220 are distributed along a first direction X.

The first housing body 210 is provided with a first opening 211 and a second opening 212. After the light emitting assembly 100 is disposed within the accommodating cavity 250, the first light beam is led out of the accommodating cavity 250 via the first opening 211, and the second light beam is led out of the accommodating cavity 250 via the second opening 212. In particular, the second condensing lens 150 of the light emitting assembly 100 is clamped at the first opening 211, and the second condensing lens 150 protrudes out of the first opening 211, The third condensing lens 190 of the light emitting assembly 100 is clamped at the second opening 212, and the third condensing lens 190 protrudes out of the second opening 212. This solution can reduce the space occupied by the first condensing lens 140 and the third condensing lens 190.

In order to reduce the probability of mutual interference between the first light beam and the second light beam within the accommodating cavity 250, in this embodiment, as viewed in the first direction X, the housing 200 includes a first concave portion 230 and a first concave portion 230 opposite to the first concave portion 230. Both the first concave portion 230 and the second concave portion 240 are concave towards an interior of the accommodating cavity 250. The fact that both the first concave portion 230 and the second concave portion 240 are concave towards the interior of the accommodating cavity 250 means that as viewed in a direction from the first light emitting element 110 to the second light emitting element 170, the first concave portion 230 is partially coincident with the accommodating cavity 250, and the second concave portion 240 is partially coincident with the accommodating cavity 250.

In this embodiment, in a direction from the first light emitting element 110 to the second light emitting element 170, the first concave portion 230 and the second concave portion 240 are disposed between the first light emitting element 110 and the second light emitting element 170. The advantage of arranging structures such as the first concave portion 230 and the second concave portion 240 is to form an arrangement space of the first light emitting element 110 within the accommodating cavity 250 and an arrangement space of the second light emitting element 170 within the accommodating cavity 250 relatively independent, thereby lowering the probability of mutual interference between the first light beam and the second light beam.

In order to further reduce the probability of mutual interference between the first light beam and the second light beam, in this embodiment, the light emitting device 10 further includes a first circular sleeve body 260. The first sleeve body 260 is disposed within the first housing body 210, and one end of the first sleeve body 260 abuts against the inner edge of the second condensing lens 150. The interior of the first housing body 260 is communicated with the second opening 212, and the first light emitting element 110 is disposed within the first housing body 260, such that the first light beam emitted from the first light emitting element 110 can propagate to the outside of the second opening 212 along a central axis of the first sleeve body 260. The first sleeve body 260 can alleviate the problem of the first light beam propagating to the second light emitting element 170, thereby reducing the probability of mutual interference between the first light beam and the second light beam.

In this embodiment, the first sleeve body 260 can be connected to the first housing body 210 and can further be connected to the second circuit board 171. In this embodiment, the first sleeve body 260 is connected to the first housing body 210, such that the first sleeve body 260 is more conveniently assembled. Further, the second circuit board 171 can be connected to the first sleeve body 260, such that the second circuit board 171 is fixed to the first housing body 210 by means of the first sleeve body 260. In this structure, connecting elements on the second housing body 220 can be reduced, which brings the convenience to assemble the second housing body 220.

The light emitting device 10 may further include a second sleeve body 270, wherein the second sleeve body 270 is disposed within the first housing body 210, and one end of the second sleeve body 270 abuts against the inner edge of the third condensing lens 190. The interior of the second sleeve body 270 is communicated with the first opening 211, and the second light emitting element 170 is disposed within the second sleeve body 270, such that the second light beam emitted from the second light emitting element 170 can propagating to the outside of the first opening 211 along a central axis of the second sleeve body 270.

The first condensing lens 140 of the light emitting assembly 100 can be disposed within the second sleeve body 270, such that a space inside the second sleeve body 270 can be more reasonably utilized and the overall volume of the light emitting device 10 can be reduced. In particular, the first condensing lens 140 can be connected to an inner wall surface of the second sleeve body 270, such that a distance between the second condensing lens 150 and the second light emitting element 170 can be controlled by controlling the position of the second condensing lens 150 within the second sleeve body 270. The second condensing lens 150 is connected to the second sleeve body 270 into a whole, which brings the convenience to assemble the second condensing lens 150.

The first light transmission portion 120 is disposed within the second sleeve body 270. In order to reduce the volume of the second sleeve body 270, in this embodiment, the second sleeve body 270 may be provided with a third opening 271, and at least a portion of the first light transmission portion 120 can protrude out of the second sleeve body 270 via the third opening 271. It should be understood that, in case that the first light transmission portion 120 is rotatable, the portion protruding out of the second sleeve body 270 varies when the first light transmission portion 120 rotates. Due to this arrangement, the second sleeve body 270 may have a smaller volume while the first light transmission portion 120 obtaining a larger volume.

In this embodiment, the light emitting device 10 further includes a sound generating apparatus 300. The sound generating apparatus is disposed within the accommodating cavity 250, and the sound generating apparatus can generate music to enhance the atmosphere of the light emitting device 10. In particular, the light emitting device 10 is connected to the second housing body 220.

In particular, in the direction from the first light emitting element 110 to the second light emitting element 170, the sound generating apparatus is disposed between the first light emitting element 110 and the second light emitting element 170, and the sound generating apparatus is particularly disposed between the first concave portion 230 and the second concave portion 240. In this solution, a space between the first light emitting element 110 and the second light emitting element 170 can be reasonably utilized, and thus the space utilization rate within the housing 200 is increased. In addition, the sound generating apparatus 300 can play a role of shielding the first light beam and the second light beam, thereby reducing the probability of mutual interference between the first light beam and the second light beam.

It should be noted that preferred embodiments of the present disclosure are given in the description of the present disclosure and the accompanying drawings. However, the present disclosure can be implemented in many different forms, and is not limited to the embodiments described in the specification. These embodiments are not intended as additional limitations to the content of the present disclosure, and are provided for the purpose of making the understanding of the disclosure of the present disclosure more thorough and complete. In addition, the above technical features are continuously combined with each other to form various embodiments not listed above, which are all regarded as the scope recited in the specification of the present disclosure. Further, for those ordinarily skilled in the art, improvements or transformations may be made according to the above description. All these improvements and transformations should belong to the protective scope of the appended claims of the present disclosure.

What is claimed is:

1. A light emitting assembly, comprising:

a first light emitting element, configured to generate a first light beam;

a first light transmission portion, at least partially disposed within a propagation path of the first light beam, the first light transmission portion comprises a plurality of first lens units, and wherein some of the first lens units exist independently, and the rest of the first lens units overlap with each other; and a driving portion, configured to drive one of the first light emitting element and the first light transmission portion, such that a position relationship between the first light emitting element and the first light transmission portion is switchable between a first state and a second state, wherein when the first light transmission portion and the first light emitting element are in the first state, the first light beam passing through the first light transmission portion presents a first pattern;

and when the first light transmission portion and the first light emitting element are in the second state, the first light beam passing through the first light transmission portion presents a second pattern which is different from the first pattern.

2. The light emitting assembly according to claim 1, further comprising a first condensing lens, wherein the first condensing lens is disposed between the first light emitting element and the first light transmission portion, and the first condensing lens converges the first light beam propagating to the first light transmission portion.

3. The light emitting assembly according to claim 1, further comprising a second condensing lens, wherein the second condensing lens is disposed on one side of the first light transmission portion away from the first light emitting element, and the second condensing lens converges the first light beam passing through the first light transmission portion.

4. The light emitting assembly according to claim 1, wherein the driving portion is configured to enable the first light transmission portion and the first light emitting element to move relative to each other along a straight line, a broken line or a curved line.

5. The light emitting assembly according to claim 1, wherein the driving portion is configured to enable the first light transmission portion and the first light emitting element to rotate relative to each other.

6. The light emitting assembly according to claim 1, wherein when the position relationship of the first light transmission portion and the first light emitting element is changed from the first state to the second state, a pattern presented by the first light beam passing through the first light transmission portion gradually changes from the first pattern to the second pattern.

7. The light emitting assembly according to claim 1, wherein the driving portion is connected with the first light transmission portion, and the first light transmission portion is drivable by the driving portion to translate relative to the first light emitting element.

8. The light emitting assembly according to claim 1, wherein the driving portion is connected with the first light transmission portion, and the first light transmission portion is drivable by the driving portion to rotate relative to the first light emitting element.

9. The light emitting assembly of claim 8, wherein the first light transmission portion comprises a first peripheral wall arranged around a second axis, the first light emitting element is disposed within the first peripheral wall, the first light beam passes through the first peripheral wall so as to be able to present the first pattern or the second pattern, and the first light transmission portion is drivable by the driving portion to rotate in a direction around the second axis.

10. The light emitting assembly of claim 9, wherein the second axis passes through the first light emitting element.

11. The light emitting assembly according to claim 1, wherein the first light emitting element and the first light transmission portion are arranged along a first direction, and the driving portion drives the first light transmission portion to rotate about a first axis, and the first axis is parallel to the first direction.

12. The light emitting assembly according to claim 11, wherein as viewed in the first direction, the first light emitting element is arranged offset from the first axis.

13. The light emitting assembly according to claim 11, wherein the light emitting assembly further comprises a first circuit board, wherein the first light emitting element is electrically connected to the first circuit board, and the first circuit board is provided with a first hole; and the driving portion is disposed on one side of the first circuit board away from the first light transmission portion, the driving portion comprises a driving shaft, and the driving shaft is engaged in the first hole and connected to the first light transmission portion.

14. The light emitting assembly of claim 1, wherein each of the first lens units is capable of converging or diverging the first light beam, and the first light transmission portion is configured to refract the first light beam through each of the first lens units, thereby enabling the first light beam passing through the first light transmission portion to present the first pattern or the second pattern, and wherein the first lens unit is of a regular hemispherical lens structure, and the first lens units have different sizes.

15. The light emitting assembly of claim 1, further comprising:

a second light emitting element, configured to generate a second light beam; and a second light transmission portion, at least partially disposed within a propagation path of the second light beam, wherein the second light beam is capable of presenting a third pattern after passing through the second light transmission portion.

16. The light emitting assembly of claim 15, further comprising a third condensing lens, wherein the third condensing lens is disposed on one side of the second light transmission portion away from the second light emitting element, and the third condensing lens is configured to converge the second light beam passing through the second light transmission portion.

17. The light emitting assembly of claim 16, wherein the third condensing lens comprises a substantially hemispherical, hollowed cover body and a plurality of second lens units disposed on the cover body, and each of the second lens units is capable of converging the second light beam, thereby enabling the second light beam passing through the third condensing lens to present a plurality of the third patterns.

18. The light emitting assembly of claim 15, wherein the second light transmission portion comprises a base material layer and a pattern layer, wherein the pattern layer defines the third pattern.

19. The light emitting assembly of claim 15, wherein the light beam emitted from the light emitting assembly to the outside is configured to present a fourth pattern, wherein the fourth pattern comprises the first pattern and the third pattern overlapped one another.

20. A light emitting device, comprising:

a housing defining an accommodating cavity; and the light emitting assembly according to claim 1, wherein the light emitting assembly is received in the accommodating cavity of the housing.

* * * * *